United States Patent [19]

Del Pozo, Jr.

[11] 4,248,031

[45] Feb. 3, 1981

[54] STRETCH WRAP MACHINE

[75] Inventor: Albert J. Del Pozo, Jr., Flushing, N.Y.

[73] Assignee: Favorite Plastic Corporation, Brooklyn, N.Y.

[21] Appl. No.: 945,472

[22] Filed: Sep. 25, 1978

[51] Int. Cl.[3] ..... B65B 11/04

[52] U.S. Cl. ..... 53/556; 53/587

[58] Field of Search ..... 53/556, 587, 588, 210, 53/211, 441; 242/75.4

[56] References Cited

U.S. PATENT DOCUMENTS

| | | | |
|---|---|---|---|
| 3,034,718 | 5/1962 | Freitas | 364/115 |
| 3,983,679 | 10/1976 | Zemke | 53/460 |
| 4,050,221 | 9/1977 | Lancaster | 53/587 |
| 4,058,954 | 11/1977 | Asami | 53/212 |
| 4,077,179 | 3/1978 | Lancaster | 53/556 |
| 4,079,565 | 3/1978 | Lancaster | 53/556 |
| 4,102,513 | 7/1978 | Guard | 242/75.4 |
| 4,109,495 | 8/1978 | Shulman | 53/210 |
| 4,136,501 | 1/1979 | Connoly | 53/441 |

FOREIGN PATENT DOCUMENTS

| | | | |
|---|---|---|---|
| 52-15791 | 5/1917 | Japan | 53/556 |

*Primary Examiner*—John Sipos

*Attorney, Agent, or Firm*—Gottlieb, Rackman & Reisman

[57] ABSTRACT

There is disclosed a machine for wrapping a skid-supported load with stretch wrap film. A roll of film is moved up and then down, at the same time that the turntable which carries the load to be wrapped rotates on its axis. The film is thus wound around the load in the form of a spiral. The machine is provided with dials for setting the skid height and the load height, so that the overall wrap is within limits set by the operator. The operator also sets a dial to control a predetermined number of extra wraps at the top of the load and at the bottom. Wherever reinforcement is required, the pressing of a "reinforce" button allows extra wraps to be formed. The tension in the film builds up from a minimum value to a maximum value during approximately the first half turn of the turntable; unlike the prior art, the maximum tension is not suddenly applied as the wrapping is in progress. The operator can also control the magnitude of this maximum tension.

25 Claims, 9 Drawing Figures

VERTICAL MOTOR CONTROL
60
M2
VERTICAL MOTOR
K1-1
K1-2
K1-3
K2-1
K2-2
K2-3
F4
10
12
TURNTABLE MOTOR
M1
K3-1
F3
10
12

+24
32
34
C
ST 30
U24-2
B
+5
BRAKE CONTROL
26
U23-3
+10
CR11
C6
BRAKE TIME CONTROL
R3
Z2
+10
MAXIMUM BRAKE CONTROL
R2
BRAKE TENSION CONTROL
R1
46
CR7
12
CR10
BRAKE PRE-TENSION CONTROL R4
CR8
BRAKE
38
CR9
CR6
F2
10

STRETCH WRAP MACHINE

This invention relates to the wrapping of loads with stretch wrap material, and more particularly to machines for wrapping loads with stretch wrap material.

In recent years, the use of stretchable films for wrapping loads has enjoyed widespread use. A typical machine for applying stretch-wrap material to a load is disclosed in U.S. Pat. No. 3,867,806, issued on Feb. 25, 1975 to Lancaster et al. A skid containing a load of cartons or the like is placed on a horizontal turntable. A roll of stretch-wrap material is mounted on a vertical shaft, and the free end of the roll is taped to the load or tucked in between some of the cartons in the load. As the turntable is rotated, the load turns with it and the film is pulled off the roll. The film gets wrapped around the load. In the above-identified Lancaster et al patent, there is almost no tension in the film at the beginning of the wrapping process. After about one revolution of the turntable, a brake is suddenly operated. The feeding of the film from the roll is now restricted, and the film stretches as it is wrapped around the load which continues to turn. It is the stretching of the film which tightly binds the various cartons in the load to each other. After a sufficient number of wraps have been formed, the film is cut; the trailing end can be held in place with a few pieces of tape, or it may naturally cling to the underlying film layer.

It is essential that tension be developed in the film, that is, that the film roll not freely feed the film. It is by braking the feeding of the film from the roll that the film stretches and tightly binds together the individual containers in the load. But the sudden application of full tension as in the Lancaster et al machine has given rise to problems, such as tearing of the film, as is to be expected when a tensionless film is suddenly braked to a high degree.

There are also other problems with prior art machines of the Lancaster et al type. While it is possible to use rolls of film of different widths, for any given load it is necessary to use a roll of film whose width (or height in a vertical orientation) is the same as the height of the load. If the dimensions are different, either all of the load will not be wrapped, or some of the film will overhang the upper or lower edge of the load. Prior art machines such as that of Lancaster et al also do not permit different levels of the load to be wrapped with different numbers of layers of film. If the same number of wraps is formed at each level of the load, there can be a considerable waste of film. While it is generally necessary to provide several layers of film at the top and bottom of the load, such a high degree of reinforcement is not generally required throughout the load. On the other hand, there may be some intermediate regions in the load which do require such reinforcement. Prior art machines of the Lancaster et al type have not allowed different regions of the load to be wrapped with different numbers of film layers.

Other prior art machines have overcome some of these problems. For example, it is known to move the film roll in a vertical direction so that a spiral wrap is formed around the load, with provision being made to form reinforcment wraps wherever they are required. But these machines are not fully automated, and they require considerable operator control depending, for example, on the height of the load to be wrapped. Also, the load is usually not placed on a turntable directly.

Rather, it is a skid, carrying the load, which is placed in the turntable. It is apparent that the skid height affects the wrapping process since the bottom of the load is at a level dependent upon the particular skid which is used. Prior art stretch-wrap machines have not permitted automated operation with variable skid heights.

It is a general object of my invention to provide a machine which overcomes the aforesaid problems.

It is also an object of my invention to provide a machine which is automatic and highly flexible in operation, permitting use in a wide variety of situations but requiring only limited operator control.

Briefly, in accordance with the principles of my invention, the width of the film roll is much smaller than the height of a typical load. The film width may be only 20 inches, while a load may be up to approximately 6 feet high. As the turntable rotates, the film roll moves up and then down. The film is thus wrapped around the load in the form of a spiral, as in the prior art. The vertical speed is slow, relative to the speed of rotation, so that the spiral sections overlap.

The load is contained on a skid, and it is the skid which is placed on the turntable. In some cases, it is necessary to wrap the skid along with the load, and in others only the load is to be wrapped. Typical skids are 4, 6 or 8 inches high. The front panel of my machine includes a dial which allows the operator to select a skid height of 0, 4, 6 or 8 inches. If a 0 height is selected, the skid will be wrapped along with the load. In all other cases, the dial is set to 4, 6 or 8 inches, depending on the actual height of the skid. The machine automatically starts wrapping the load at a height above the turntable which is 4, 6 or 8 inches, i.e., the wrapping begins at the bottom of the load (the top of the skid).

Another dial is provided for allowing the operator to set the height of the desired wrap, as measured from the top of the turntable. The operator may select a height anywhere from 20 inches to 72 inches, in 4-inch increments. The height setting which is selected is measured from the top of the turntable, and thus includes the skid height. For example, suppose that a 4- inch skid is used and the load itself is 60 inches high. Whether or not the skid is to be wrapped with the load, a height setting of 64 inches is used if the wrap is to extend to the top of the load. If the skid is not to be wrapped with the load, the skid height is set at 4 inches; if the skid is to be wrapped with the load, the skid height is set at 0 inches.

The front panel of the machine also includes a dial which allows the operator to select a number of wraps to be used at the bottom of the load and at the top; the operator can select anywhere from 1 to 6 wraps. A fourth dial on the front panel allows the operator to select the maximum brake tension, that is, the maximum tension which will be developed in the film.

At the start of the wrapping cycle, there is negligible tension in the film. The roll is almost "free wheeling", only a slight tension being developed to prevent the roll from excessive turning as film is pulled from it. The film is taped to the load or tucked between cartons in the load such that the bottom of the film is either at the level of the bottom of the skid, or at the level of the bottom of the load, depending on whether the skid is to be wrapped with the load. The film roll then moves down to the level of the turntable. If a skid height of 0 has been set, the turntable then starts to turn, and the skid and load are wrapped. If one of the skid heights of 4, 6 or 8 inches has been selected, the film roll moves upward while the turntable remains stationary. Only when the roll reaches the top of the skid does the turntable start to turn. At this time, no further upward movement of the roll takes place. The turntable simply turns and forms a number of wraps equal to the setting of the associated dial on the front panel. After 1–6 wraps have been formed at the bottom of the load (including the skid, if a 0 skid height was selected), the film roll starts to move upward as the turntable continues to turn.

The upward movement of the film roll results in a spiral wrap around the load. When the roll has advanced upward to the point at which the top of the roll is at a height above the turntable equal to the height setting, the roll stops moving. At this time, wraps are formed at the upper end of the load, the number of wraps depending upon the number of wraps set on the associated dial. (As will be explained below, the number of wraps formed at the top of the load can be up to one wrap greater than the number set on the dial.) Thereafter, the film roll moves downward, forming another sprial wrap around the load (and the skid, if a skid height of 0 inches was selected). At the end of the cycle, the turntable stops turning and the film roll comes to a stop. The film is cut, and the trailing end is secured to the film layer directly beneath it.

On the front panel of the machine there is a "reinforce" button. Whenever this button is depressed, the film roll stops moving in the upward or downward direction, while the turntable continues to rotate. This allows a number of extra wraps to be formed around the load in any region selected by the operator, in the event the operator determines that the nature of the load is such that reinforcement is required in certain regions.

An important feature of my invention is the manner in which the film tension is developed. The turntable does not revolve a bit before any appreciable tension is developed, the film tension suddenly increasing from the minimum to the maximum value as in the prior art. Instead, the film tension builds up continuously from the minimum to the maximum value during approximately the first turntable half revolution. The front panel includes a dial which allows the operator to select the maximum brake force (film tension). The maximum tension is selected in accordance with the nature of the load. By allowing a gradual build-up in the tension during approximately the first turntable half revolution, a very smooth operation is achieved; even higher maximum tensions than those used in the prior art can be used because of the absence of abrupt tension changes, an advantage which is quite important from a practical point of view. In general, the film tension reaches the maximum value between approximately one-sixteenth and one complete revolution of the turntable. (The build-up in the preferred embodiment takes place during the first half revolution.) While the build-up can be slower, e.g., requiring more than a full turn, there is no advantage in allowing the build-up to take longer than one turntable revolution. In general, the continuous tension build-up should take place during the first turn, and preferably by the time the first half turn is completed, in order not to waste excessive film (film under less than the full tension contributes little to the wrapping); in order to minimize the possibility of the film tearing, the tension build-up should take at least one-sixteenth of a turn.

The gradual build-up of tension not only allows higher maximum tension values to be used, but it even saves film. In the prior art, as much as one full turn, under little tension, took place, the first wrap thus contributing little to the wrapping function. But in accordance with the invention, full tension may be achieved in as little as one-sixteenth of a turn, thus "wasting" very little film.

Further objects, features and advantages of my invention will become apparent upon consideration of the following detailed description in conjunction with the drawing, in which:

FIGS. 3–8 depict the control circuit of the machine, with

Figure 3:
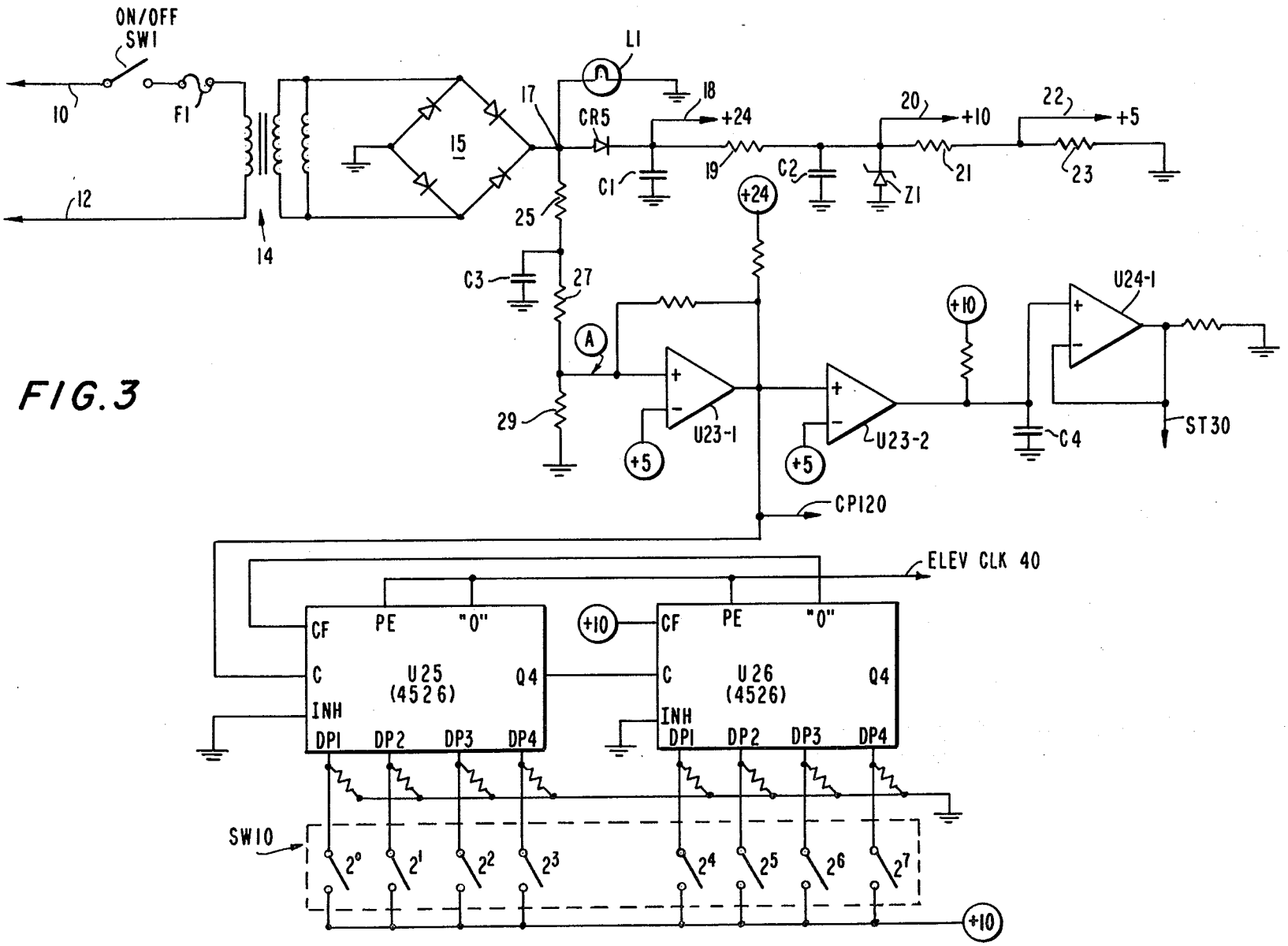
Figure 4:
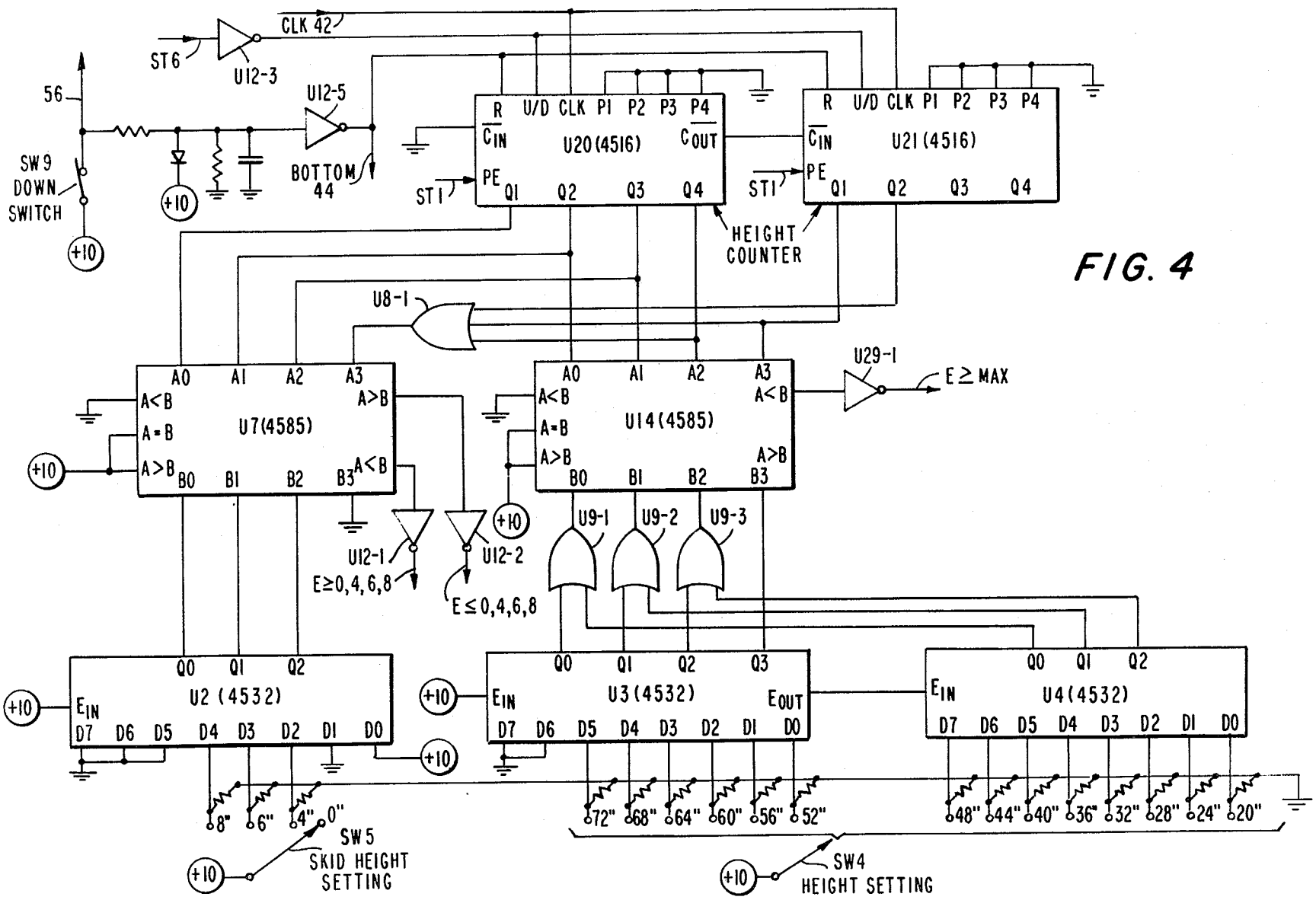
Figure 5:
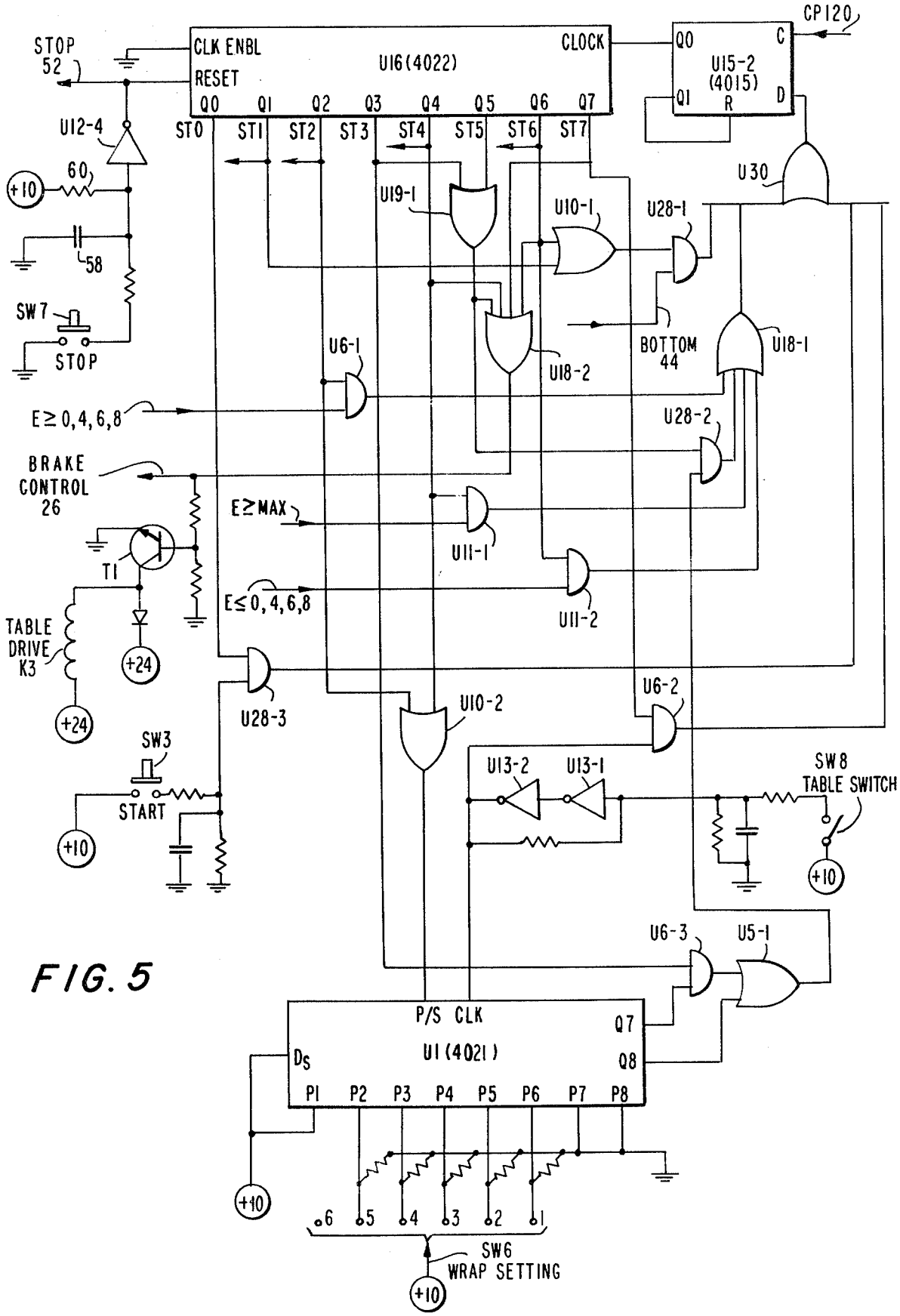
Figure 6:
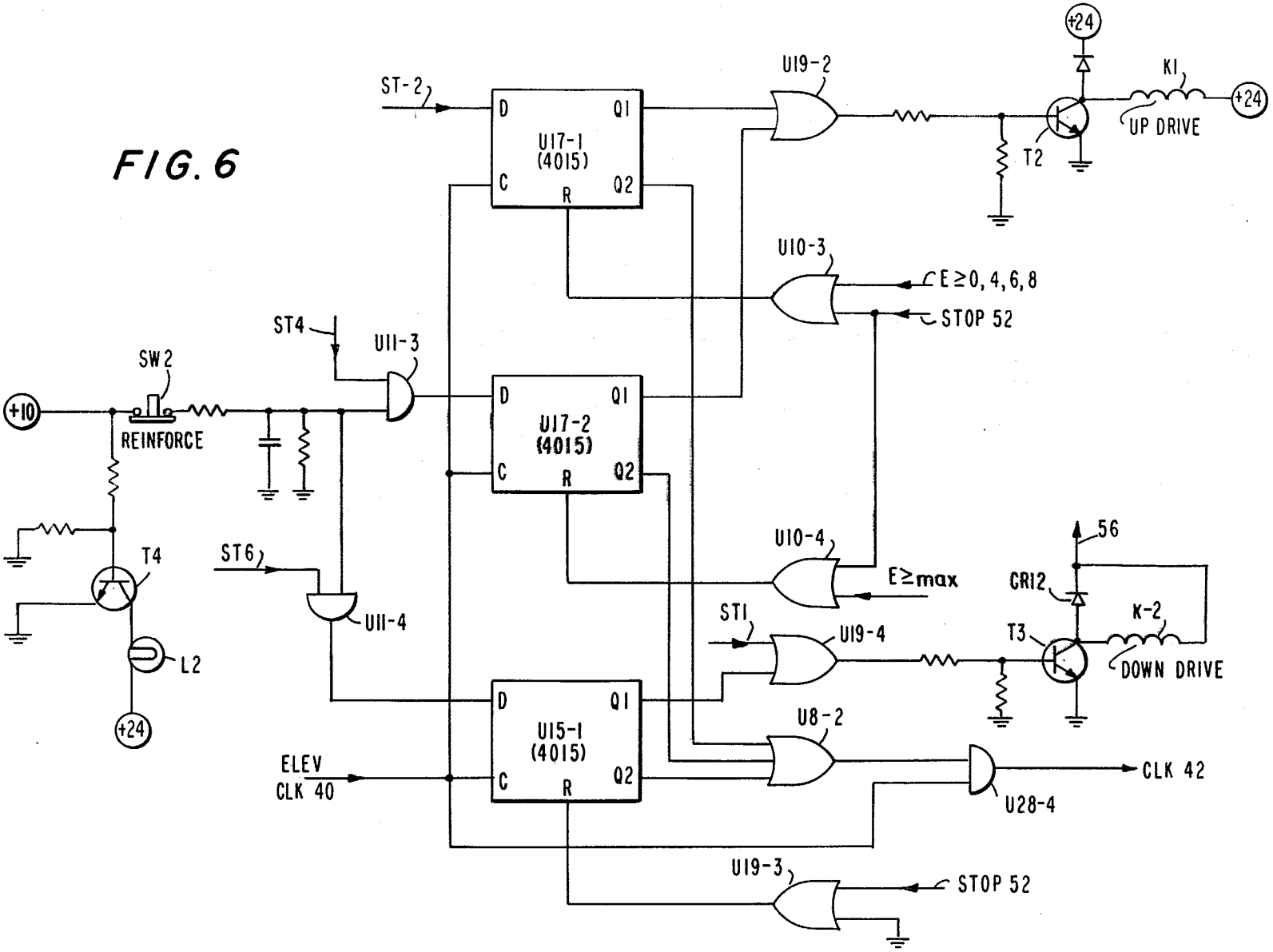
Figure 7:
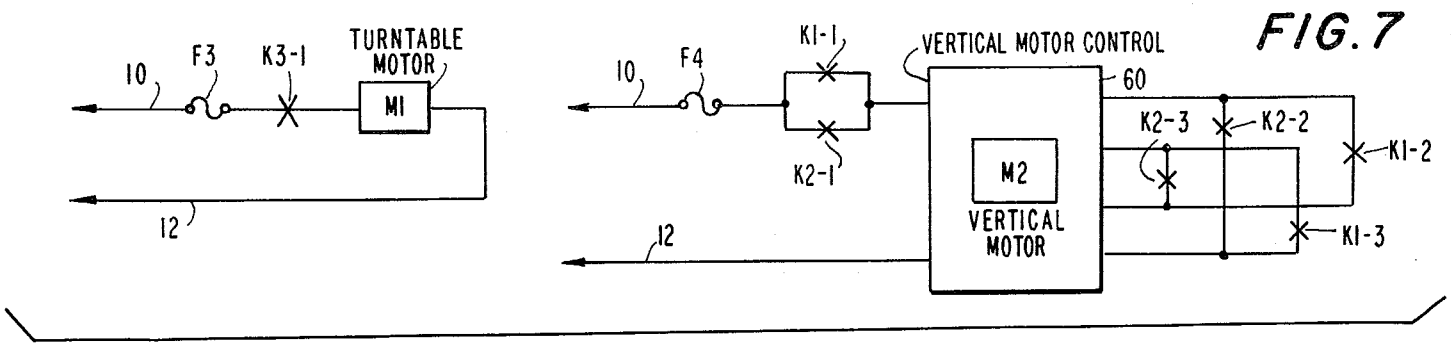
Figure 8:
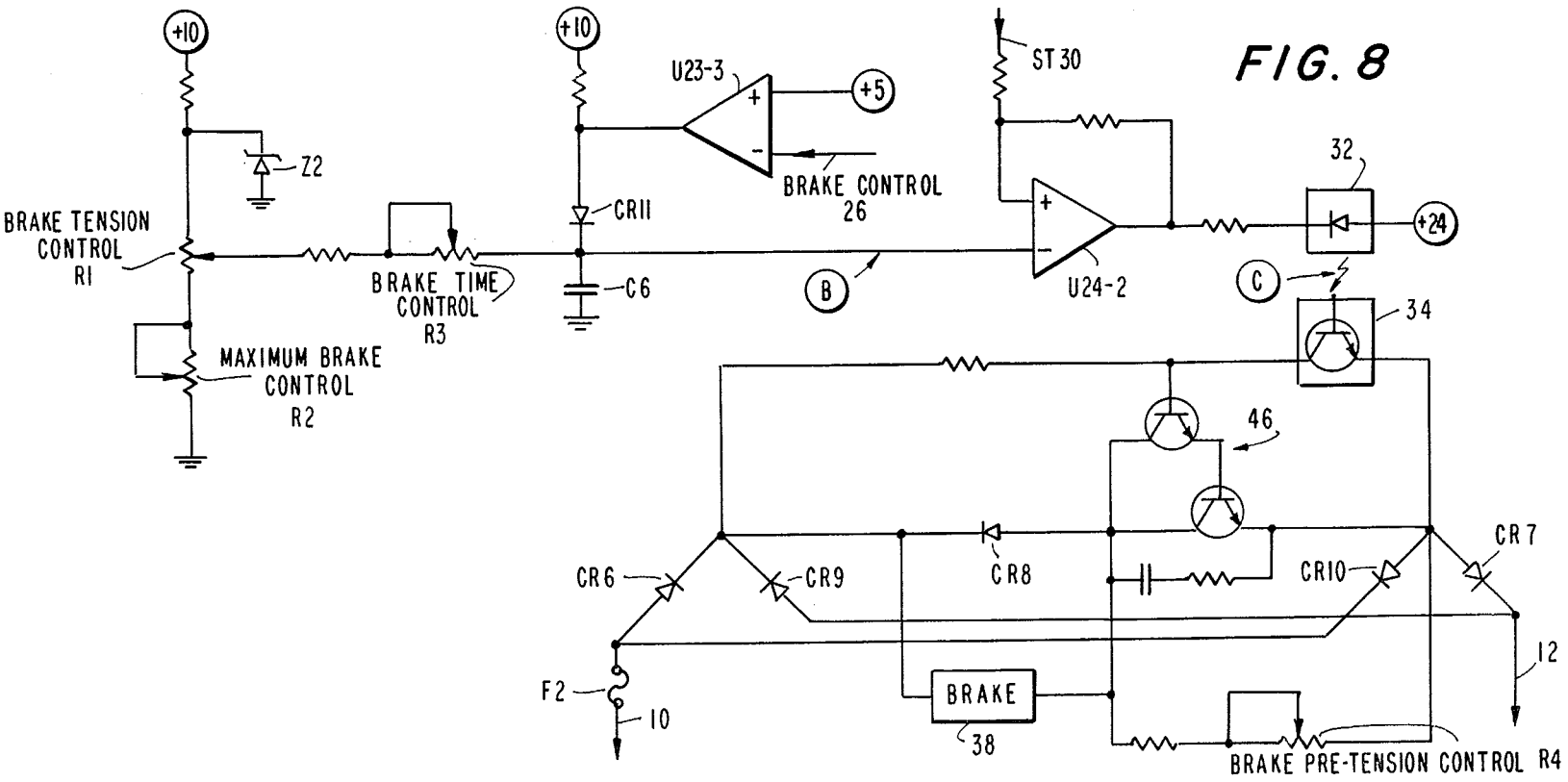
Figure 9:
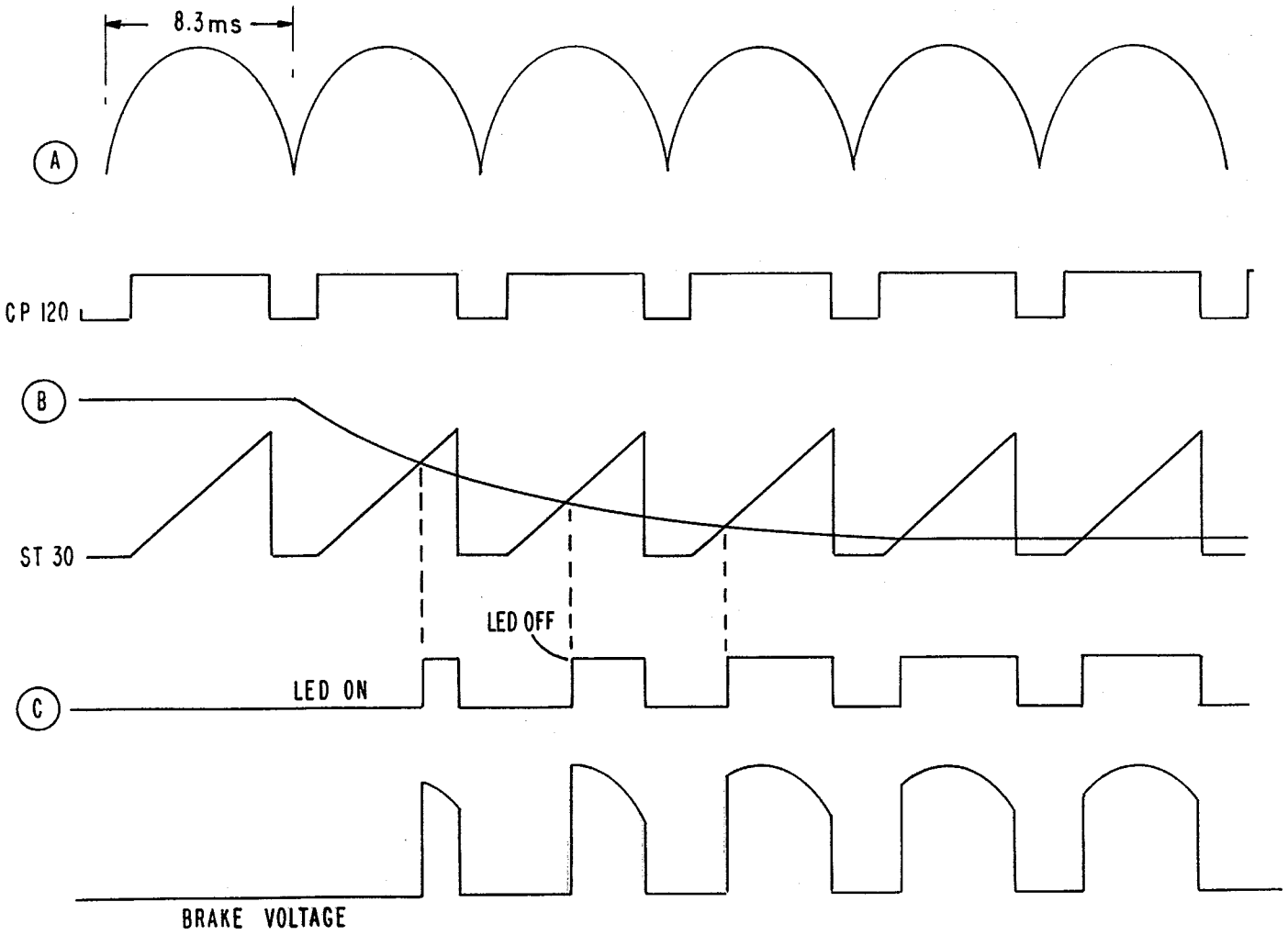

- FIG. 3 showing primarily the circuits for deriving the several DC supplies used in the remainder of the circuit and certain clock signals;
- FIG. 4 depicting primarily the circuitry for comparing the film roll height to the skid height and load height dial settings;
- FIG. 5 depicting primarily the state counter which is cycled through eight states for controlling eight different sub-operations;
- FIG. 6 depicting circuits for controlling some additional control functions;
- FIG. 7 depicting the motor circuits; and
- FIG. 8 depicting the circuit for controlling the film tension; and FIG. 9 depicts certain waveforms which will facilitate an understanding of the circuit of FIG. 8.

Throughout the drawing, individual integrated circuits or chips are identified by the letter U followed by a number. For example, element U7 on FIG. 4 is a comparator. Following some of the U identifications, the actual chip number is shown in parentheses. Not all of the pin connections to each chip are shown. Only those connections required for an understanding of the invention are depicted. For example, the DC supply connections and the ground connections for the chips (other than the connections used for control purposes) are not illustrated since these connections are not necessary for an understanding of the present invention and will be apparent to those skilled in the art.

Certain other chips contain designations such as U6-1 on FIG. 5. This particular gate is an AND gate, as can be appreciated from the gate symbol itself. The suffix at the end of the gate designation simply refers to the fact that typical chips include several gates in them. If a chip with four AND gate has been used, then all of these gates are identified by the same U number, but each of them has a different numeral 1–4 as a suffix.

Figure 1:
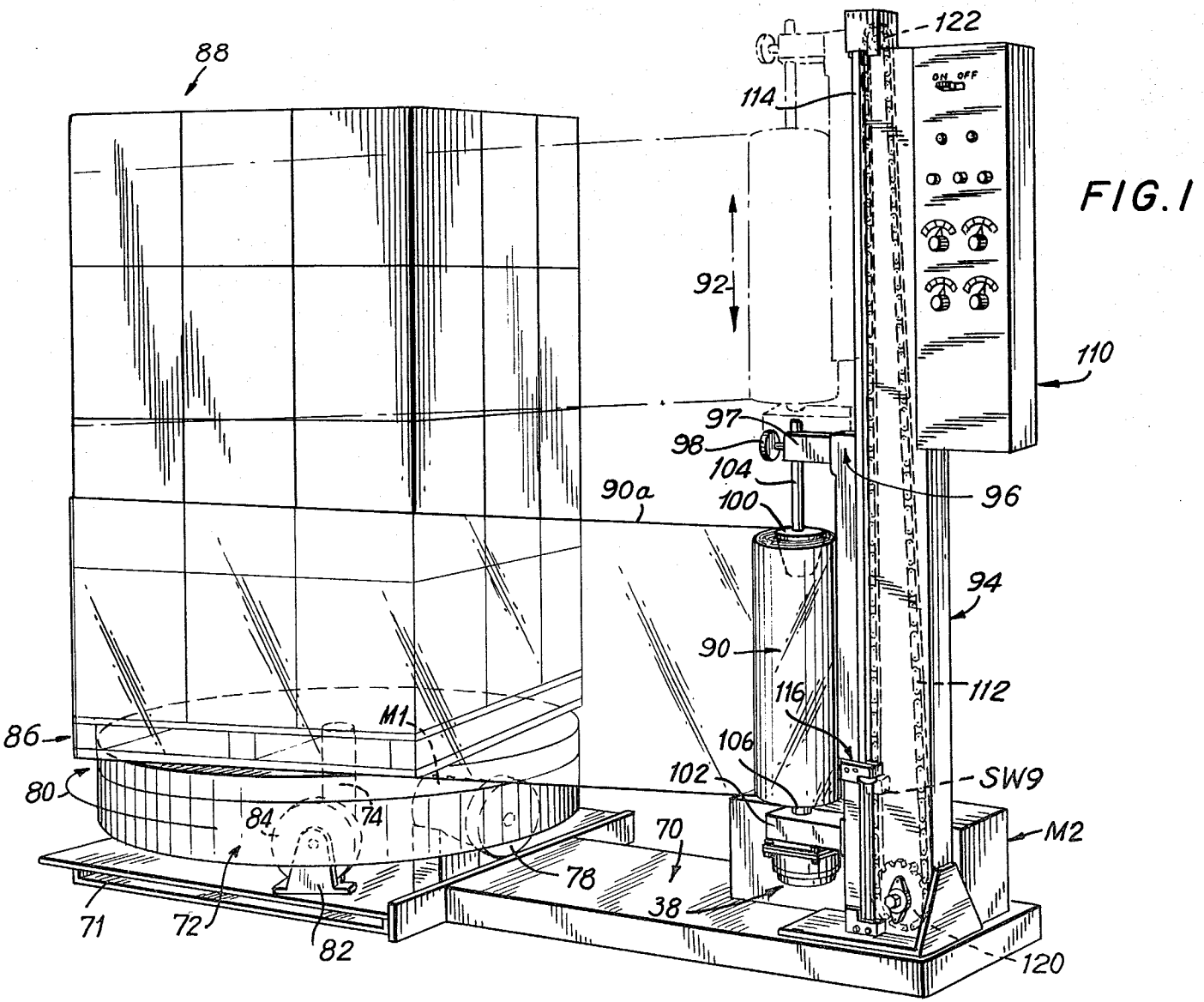
FIG. 1 is a perspective view of the machine of my invention.

Control panel box 110 on the machine of FIG. 1 includes several switches, dials and lights. The control panel itself is shown in greater detail in FIG. 2. At the top of the control panel is the main on/off switch SW1. Directly beneath this main switch, there are two lamps L1, L2. When lamp L1 is illuminated it is an indication that the AC power has been turned on (by means of the on/off switch). When lamp L2 is on, it is an indication that the DC potentials for the circuit are being developed.

Switch SW3 is the start button; the operator depresses this button to initiate a wrap cycle. Similarly, switch SW7 is the stop switch which, when depressed, stops the machine. The "reinforce" button SW2 stops vertical motion of the film roll as described above, in order to allow additional wraps to be formed at any level of the load as determined by the operator.

At the bottom of the control panel are four dials. The "No. of wraps" dial can be set at any one of the numbers 1-6 to control a switch SW6. This switch, to be described below, controls the number of wraps at the bottom and the top of the load. The "height" dial setting, which controls a switch SW4, can range from 20 inches to 72 inches and determines the maximum height to which the film roll moves. A setting of 60 inches, for example, causes the film roll to move up until the upper edge of the film is 60 inches above the turntable. The skid height dial controls a switch SW5 which determines the level assumed by the bottom edge of the film at the start of the wrap cycle. A skid height of 0 is selected if the skid is to be wrapped together with the load. If the skid is not to be so wrapped, a setting of 4, 6 or 8 is selected, the setting being the actual height of the skid being used. (Typical skids have heights of 4, 6 or 8 inches.)

Finally, the brake tension dial allows the operator to select the maximum film tension, the dial controlling a potentiometer R1 in the circuit as will be described below. The maximum film tension is in the same range as film tensions used in the prior art although, as mentioned above, higher maximum tensions can be used with safety. The maximum tension to be used for any type of load and film can be learned by experience. It is not the actual film tension which comprises an aspect of my invention, but rather the manner in which the tension is built up continuously at the beginning of a wrapping operation.

Although not shown in FIGS. 1 and 2, the several fuses included in the circuit, to be described below, can also be mounted on the control panel.

The machine itself is shown in FIG. 1. The frame of the machine consists of a base 70 and a vertical post 94. The control panel box 110, previously described, is mounted at the top of the vertical post. To facilitate relocation of the machine, lift slots 71 are provided at the left end of the base.

The turntable 72 is mounted on a shaft 74 at the left end of the base. A series of brackets 82 and guide rolls 84 is provided within the turntable around its periphery in order to support the turntable and allow it to rotate. Motor M1 is mounted underneath the turntable on top of the base and is provided with a drive roll 78 which bears against the undersurface of the top of the turntable. Motor M1 operates in only one direction, in order to control rotation of the turntable in the direction shown by arrow 80. The control circuit is contained in control panel box 110, with various wires (not shown) being extended to several other elements distributed throughout the machine, such as motor M1.

In the drawing, a skid 86 is shown on the turntable, and a load of cartons 88 is shown on top of the skid. The skid includes slots to allow it to be moved by a fork lift. In order that the fork lift not have to be re-positioned after the wrapping has been completed and the load is to be removed, it is advantageous to have the turntable automatically stop at the same position in which it starts during a cycle. It is also necessary to count the number of turntable revolutions when the several wraps are being formed at the bottom and the top of the load. Toward this end, a microswitch (not shown) is mounted on the base under the turntable, and the turntable includes a lug which closes the switch contacts whenever the turntable returns to the starting position. This microswitch is labeled table switch SW8 on FIG. 5.

A rod 114 extends along post 94, and carriage 96 moves up and down along the rod. The carriage carries film roll 90, the free end of the film **90*a* being shown wrapped around the load at the start of a wrapping cycle. The carriage includes a bracket 102 through which a shaft 106 passes. A chuck (not shown) is mounted at the upper end of shaft 106, the film roll being inserted on this chuck. Brake 38 is secured to the underside of bracket 102 and operates on shaft 106 to brake it. The film is pulled off the roll by the rotating load. As the force of brake 38** increases, the tension in the film increases.

At the top of carriage 96, there is another bracket 97 through which shaft 104 passes. At the lower end of this shaft another chuck 100 is provided. In order to insert a new roll of film on the machine, handwheel 98 is released and shaft 104 is raised. The new film roll is inserted on the lower chuck at the top of shaft 106, and then shaft 104 is lowered so that chuck 100 moves into the roll at its top. Lastly, handwheel 98 is locked.

The carriage 96 is moved up and down in the direction of arrows 92, the phantom lines showing the carriage and film roll in position toward the top of the machine. A normally-closed microswitch SW9 is attached to the post 94, and a cooperating lug 116 is mounted on the carriage. When the carriage is moved to its lowermost position and the lug engages microswitch SW9, the switch contacts open. This is a signal to the control circuit that the carriage is at its lowermost position, with the bottom of the film roll being at the level of the top of the turntable. Switch SW9 is referred to in the remainder of this description as the "down" switch, and it is shown in FIG. 4.

The carriage itself is driven by a drive chain 112, the drive chain being secured to the carriage. The drive chain extends around a pulley sprocket 122 at the top of post 94 and a motor sprocket 120 at the bottom of the post. Sprocket 120 is driven in either direction by the shaft of motor M2, the motor being located on the other side of post 94. Depending upon the direction in which motor M2 operates, carriage 96 is moved up or down.

Although not shown in the drawing, limit stops are preferably provided at the top and bottom of post 94 to limit motion of carriage 96. A torque limiter between motor M2 and sprocket 120 can also be provided so that if for one reason or another the carriage actually reaches a limit stop, the motor continues to operate without actually turning the sprocket and driving chain 112.

FIG. 3 depicts the elements which derive both the supply voltages and the clocks for the remainder of the circuit. The main on/off switch SW1 couples the power lines 10 and 12 through fuse F1 to the primary winding of transformer 14. The secondary windings are connected to a conventional power supply bridge 15 whose output at point 17 is an unregulated, unfiltered 24-volt (peak) DC potential. This potential illuminates lamp L1 on the control panel to indicate that AC power is available. Diode CR5 and capacitor C1 filter the potential to derive a low-ripple, 24-volt potential on conductor 18. This potential is extended to various parts of the circuit—whereever a 24-volt source is indicated—and is used primarily for the analog circuitry and the relay drivers.

Resistor 19, capacitor C2 and zener diode Z1 derive a regulated, 10-volt DC potential on conductor 20, this potential also being extended throughout the circuit for powering the logic elements. Resistors 21 and 23 form a voltage divider to produce a 5-volt regulated potential on conductor 22, this potential being extended throughout the circuit and functioning as a bias voltage for the analog circuits.

Resistors 25, 27 and 29, and capacitor C3, function as a filter and voltage divider, and operate on the unregulated, unfiltered 24-volt potential at point 17. Comparator U23-1 is configured to "square" the 120-Hz, full-wave rectified waveform at point A, in order to derive a 120-Hz, square-wave clock with fast edges at its output. The clock signal, CP120, is used elsewhere in the circuit as will be described.

The clock waveform at the output of comparator U23-1 is fed to the plus input of open-collector comparator U23-2. When the CP120 signal is low, capacitor C4 discharges through the output circuit of the comparator. When the clock potential is high, capacitor C4 charges. The capacitor voltage takes the form of a sawtooth waveform. Operational amplifier U24-1 is configured as a unity-gain voltage follower to prevent loading of the high output impedance sawtooth generator U23-2. A sawtooth waveform thus appears on conductor ST30. FIG. 9 depicts the waveform at point A, and also the clock pulse CP120 and sawtooth ST30 waveforms. (The feedback provided for comparator U23-1 provides the duty cycle shown in FIG. 9 for the CP120 clock waveform.)

Motor M2 controls up and down motion of the film roll carriage. The motor and chain drive are designed to move the carriage at a rate of two inches per second. Clock pulses on ELEV CLK conductor 40 occur at the nominal rate of one pulse per second, one pulse being generated for every two inches of carriage travel. Ordinarily, it would be sufficient to divide the clock pulse rate on conductor CP120 by a factor of 120 in order to derive the proper 1-Hz pulse rate on ELEV CLK conductor 40. However, in the event the carriage drive is such that the carriage travel is slightly different from two inches per second, the CP120 clock pulses are divided by a different factor so that a single ELEV CLK pulse is generated for every two inches of carriage travel.

Each of chips U25 and U26 is a programmable divide-by-N 4-bit counter. The two chips are connected together as shown, for example, in FIG. 9 on page 5-318 of Volume 5, Series B of the "Semiconductor Data Library" published by Motorola Inc. (1976). (The several different types of digital logic chips used in the circuit can all be found in this publication, it being noted that Motorola uses the prefix 1 for all chip number designations. The analog integrated circuits used in the illustrative embodiment of the invention are described in Volume 6 of the same Motorola publication.) In the configuration shown in FIG. 3, the CP120 pulses applied to the C input of chip U25 are divided by a factor N, the "divided" pulses appearing on conductor 40. The value of N is determined by the settings of the eight switches SW10, coupled to the DP1-DP4 inputs of the two chips. Each switch, when closed, adds a component to the factor N, the individual components ranging from $2^0$ through $2^7$ as indicated.

Ordinarily, the eight switches SW10 would be set to represent a total value of N=120. However, suppose, for example, that the lineal volocity of the carriage, for one reason or another, is only 1.8"/second. In such a case, N must be set to 132, rather than to 120, to slow down the ELEV CLK pulses by 10%. In this manner, a single pulse is generated on conductor 40 for each 2-inch increment of the carriage travel in either direction. An important advantage of this overall technique is that no sensors are required to determine the carriage position. The ELEV CLK pulses always accurately represent the carriage motion. Even if the line frequency changes, and along with it the rate of the ELEV CLK pulses, because motor M2 is a synchronous motor its speed changes to the same degree; each ELEV CLK pulse still represents a 2-inch increment of carriage travel.

The actual pitch of the spiral wrap formed around the load is determined by the lineal velocity of the carriage (2"/second) and the speed of the turntable. The turntable is driven by motor M1 (FIG. 1), and in the illustrative embodiment of the invention the turntable rotates at a speed of 7 revolutions/minute.

The system logic is controlled by a state counter which cycles through eight states, 0–7. In each state, a different operation takes place, and at the end of the operation the counter is advanced to the next state. Before actually describing the logic in detail, the operations performed in each state will be described briefly.

State 0

This is the initial state of the machine—the state which is entered when the machine is first turned on, and at the end of each complete cycle. The several DC potentials are generated, and the minimum voltage is applied to the brake 38 to produce the minimum value of film tension.

State 1

When the start button SW3 on the control panel is depressed, the state counter switches from 0 to 1. Motor M2 is energized and drives the film roll carriage in the downward direction.

State 2

When the carriage reaches its lowest position, normally-closed down switch SW9 opens. At this point in the carriage travel, the bottom of the film roll is at the same level as the bottom of the skid (the top of the turntable). The opening of switch SW9 causes the state counter to switch from 1 to 2. Motor M2 now starts to turn in the opposite direction causing the carriage to move up. At the same time, a carriage height counter starts to count the ELEV CLK pulses on conductor 40. Since the clock pulses are synchronized to the velocity of the carriage by chips U25 and U26 on FIG. 3, the height counter represents the carriage position at all times. (The height counter actually represents the total number of 2-inch increments, this being the resolution of the vertical motion which can be controlled.) The skid height is initially set by dial SW5 (FIG. 2). When the height count equals the skid height, vertical motion stops and the state count switches from 2 to 3. In the event the skid is to be wrapped together with the load, the skid height setting (0) matches the carriage height at the beginning of state 2, and the state counter immediately switches to state 3.

State 3

In state 3, motor M2 is off and the film roll does not continue to rise. Instead, the turntable motor M1 is turned on, and the turntable starts to rotate. Each time that the turntable finishes a turn, a turn counter is incremented. It is during state 3 that a pre-set number of wraps are formed at the bottom of the load, the exact number depending on the setting of dial SW6 (FIG. 2). When the turn count equals the number represented by dial SW6, the state counter advances to state 4.

Figure 2:
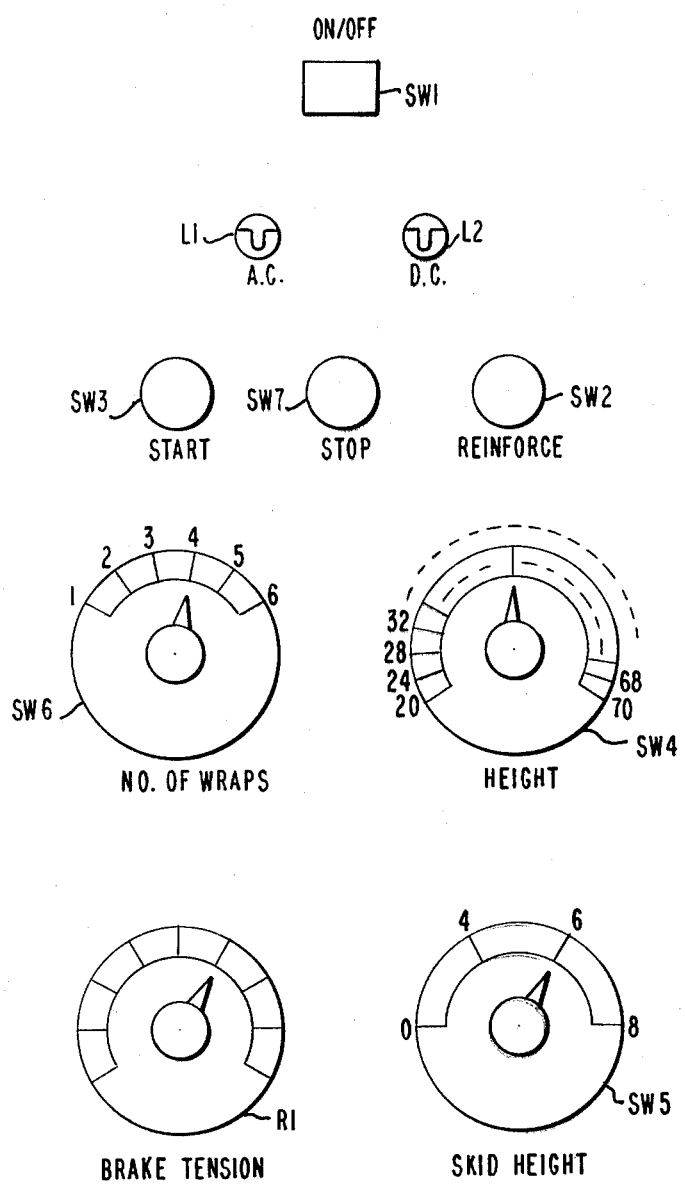
FIG. 2 depicts the various controls and signal lights included on the front panel of the machine of FIG. 1.

It is during state 3 that the film tension builds up continuously from the factory-set minimum value to the maximum value set by the operator (brake tension dial on FIG. 2). The factory-set value provides a small back pressure when the film is pulled from the roll so that the roll does not spin completely free. In the illustrative embodiment of the invention, the full brake voltage (film tension) is developed by the end of the first half revolution of the turntable, and the final film tension is then maintained throughout the remainder of the cycle. (In general, the maximum film tension should be built up by the time the turntable has made anywhere between one-sixteenth and one full term.)

State 4

After the desired number of wraps is achieved at the bottom of the load, carriage motor M2 is once again activated and ELEV CLK pulses are once again counted so that the height counter represents the carriage level. During state 4 the turntable continues to turn so that a spiral wrap is formed. When the height count reaches a value equal to the height setting desired by the operator (as represented by height dial SW4 on FIG. 2), the system switches to state 5.

At any time during state 4, if the operator depresses the reinforce button SW2 on FIG. 2, motor M2 is de-energized and the height counter stops counting. Since the turntable motor continues to operate (the turntable turning from the beginning of state 3 through the end of state 7), additional reinforcing wraps may be formed at any level desired by the operator. With the release of the reinforce button, the vertical film travel resumes.

State 5

With the carriage at its uppermost position, as determined by the height dial set by the operator, motor M2 turns off. The turntabl continues to turn, thus forming reinforcing wraps at the top of the load. The turntable makes a number of full revolutions equal to the number represented by the "No. of wraps" dial SW6 on the control panel. In the usual case, an additional fraction of a wrap will also be made. There is no fixed turntable position when the maximum height is reached because the maximum height can be varied. Consequently, should the maximum height be reached just prior to operation of the switch which increments the turntable turn count, the turntable counter would register the first count even though only a small fraction of a wrap at the top of the load was actually made. For this reason, in state 5, the turntable switch must be activated a number of times which is greater by 1 than the value represented by switch SW6 on the control panel. Thus for a setting of four wraps, for example, while exactly four wraps will be formed at the bottom of the load before the carriage starts to move up, somewhere between four and five wraps will be formed at the top of the load before the carriage starts to move down. After the turntable switch has been activated the proper number of times during state 5, the system switches to state 6.

State 6

Motor M2 now starts to move the carriage downwardly. For each two inches of lineal carriage travel, the height counter is decremented by one count. If the reinforce button SW2 is depressed, downward motion of the carriage is inhibited and the height count remains fixed. Upon release of the button, downward motion of the carriage and decrementing of the height counter resume. When the height counter is decremented down to the value represented by skid height dial SW5, at which time the bottom of the film is either at the bottom of the skid (for a skid height of 0), or at the bottom of the load (for any other skid height value), the system switches to state 7.

State 7

In this state, the turntable continues to turn until the turntable switch operates for the first time. The turntable motion is always started at the same position, and the turntable therefore always stops at the same position. This is important from a practical point of view because the skid always finishes in the same orientation in which it began, facilitating unloading of the skid and load with the same fork lift which originally placed them on the turntable. As soon as the turntable switch operates, the system is placed in state 0 preparatory to another cycle of operation. At this time, the film tension drops to its minimum value and the film is cut from the roll prior to removal of the load.

Chip U16 on FIG. 5 is the state counter. Only one of the eight outputs Q0–Q7 is energized at any one time. The eight outputs are coupled to the eight respective conductors ST0–ST7 which are extended throughout the logic circuit. The counter advances whenever a pulse is applied by shift register U15-2 to the CLOCK input. The shift register has four outputs Q0–Q3, of which only outputs Q0 and Q1 are utilized. Whenever the output of OR gate U30 goes high, the next pulse (which arrives within 8.3 milliseconds) on conductor CP120 causes the Q0 output of the shift register to go high, thus advancing counter U16. The next CP120 pulse causes output Q0 of the shift register to go low and output Q1 to go high. Output Q1 is coupled back to the reset input of the shift register, and thus output Q1 goes low immediately after it goes high. The net result is that any pulse which is transmitted through OR gate U30 advances counter U16 to the next state.

Before the machine is turned on, capacitor 58 is discharged. As soon as power is applied, the output of inverter U12-4 goes high to rest counter U16 to the 0 state (with conductor ST0 going high—a "logic 1"). As capacitor 58 charges through resistor 60, a point is reached at which the output of inverter U12-4 goes low, thereby disabling the reset input of counter U16. It is from this point on that the counter can cycle and control the machine operation.

The output of inverter U12-4 is extended along STOP conductor 52 to inputs of OR gates U10-3, U10-4 and U19-3 on FIG. 6. The initial pulse on the conductor when the machine is first turned on is extended through each of these gates to the reset inputs of shift registers U17-1, U17-2 and U15-1. As will be described below, these three shift registers control the turning on of motor M2 and the incrementing or decrementing of the height counter. By resetting each of the shift registers when the machine is first turned on, motor M2 is held off and the height counter is prevented from counting.

It should also be noted that the operation of stop button SW7 (FIG. 5) results in a ground potential being applied to the input of inverter U12-4. The inverter thus generates a reset pulse at its output. Thus if the operator for any reason stops the machine, the logic enters state 0 and any cycle in progress is aborted.

With the system in state 0, no operations take place. The only function of the high potential on conductor ST0 is to enable one input of gate U28-3 (FIG. 5). When start switch SW3 is depressed by the operator, a positive potential is applied to the other input of this gate. The pulse at the gate output is extended through OR gate U30 to advance counter U16 to state 1.

The positive potential which now appears on conductor ST1 is extended through OR gate U19-4 (FIG. 6) to the base of transistor T3. The collector of the transistor is connected through the coil of down drive relay K2 to conductor 56. This conductor, in turn, is connected through normally-closed down switch SW9 (top left of FIG. 4) to a positive potential. Relay K2 thus operates to control motor M2 to drive the carriage downwardly. When the film roll carriage reaches its lowermost position, corresponding to the top of the turntable, down switch SW9 opens. At this time, current ceases to flow through transistor T3 (FIG. 6) and relay K2 de-energizes. Diode CR12 is provided to allow the relay coil current to flow through it until it dissipates, without creating an excessive transient voltage at the collector of transistor T3.

During the downward carriage travel, the positive potential extended through switch SW9 is applied to inverter U12-5 (FIG. 4) whose output thus remains low. But as soon as the switch opens, the output of the inverter goes high. This has two effects on the system. First, the positive potential is applied to the reset input of each of counters U20 and U21. These counters are cascaded, and together comprise the height counter referred to above. The counters are thus reset. In addition, the positive potential at the output of the inverter is extended along BOTTOM conductor 44 to one input of gate U28-1 (FIG. 5). The positive potential on conductor ST1 is extended through OR gate U10-1 to the other input of gate U28-1. Thus when down switch SW9 is opened, a positive pulse is extended through gate U28-1 and OR gate U30 to advance counter U16 from state 1 to state 2.

It should be noted that conductor ST1 is connected to the PE input of each of chips U20 and U21 (FIG. 4). Each of these chips is a binary up/down counter having four presetting inputs P1–P4, and a preset enable (PE) input. When the PE input is high, a count is pre-set into the counter in accordance with the potentials applied to the P1–P4 inputs. Because all of these inputs of both counters are grounded, the count in each counter is pre-set to 0 during state 1. (The positive pulse applied to the reset (R) input of each counter at the end of state 1 further ensures that an initial count of 0 is set into each counter.)

The two counters are cascaded as depicted in FIG. 3 on page 5-291 of the Motorola publication referred to above. The two chips function as a counter, incrementing or decrementing whenever a pulse appears at the CLK inputs. When the U/D inputs are high, the counters increment, and when the U/D inputs are low, the counter decrement. Conductor ST6 is connected through inverter U12-3 to the U/D inputs of the counters. Since conductor ST6 is high only during state 6, the counters are ordinarily enabled to count up; they are enabled to count down only during state 6.

Although the two chips provide an 8-bit count, only five bits are used. The least significant bit is represented by output Q1 of chip U20, and the most significant bit is represented by output Q1 of chip U21. The initial count of 0 which is pre-set during state 1 corresponds to the bottom of the film roll being at the level of the bottom of the skid, i.e., the top of the turntable.

In state 2, conductor ST2 is high in potential. This conductor is coupled to the D input of shift register U17-1 (FIG. 6). The shift register has four outputs Q1–Q4 but only outputs Q1 and Q2 are utilized. Initially, all four outputs are low, as a result of the resetting of the shift register by the high potential on STOP conductor 52 as described above. But with the D input high, the first ELEV CLK pulse on conductor 40, which conductor is connected to the C input of the shift register, causes the Q0 output of the shift register to go high. This has no effect on the circuit operation. The next ELEV CLK pulse causes the Q1 output of the shift register to go high. A positive potential is now extended through OR gate U19-2 to the base of transistor T2. The transistor turns on and current flows through the coil of up drive relay K1. The energization of relay K1 results in motor M2 moving the carriage in the upward direction. The next pulse on conductor 40 causes output Q2 of shift register U17-1 to go high. Output Q1 remains high because the D input of the shift register is still energized by the high potential on conductor ST2 so that motor M2 continues to drive the carriage upward. But as soon as output Q2 goes high, a positive potential is extended through OR gate U8-2 to one input of gate U28-4. The clock pulse on conductor 40 is thus extended through gate U28-4 to CLK conductor 42. The Q2 output of shift register U17-1 remains high throughout state 2 because the D input remains high. Successive clock pulses on conductor 40 are extended to conductor 42. These pulses are applied to the CLK inputs of the height counter on FIG. 4. It will be recalled that a single pulse on conductor 40 is generated for each two inches of carriage travel. Thus during state 2, the height counter starts to increment, with the total count representing the number of two-inch increments taken by the carriage in the upward direction.

The reason for not utilizing the Q0 output of shift register U17-1 is the following. At the end of state 1, motor M2 is driving the carriage downwardly. At the beginning of state 2, motor M2 changes direction. To allow the motor to "coast" down, a 1-second delay is provided, this delay being the time between successive clock pulses on ELEV CLK conductor 40. The first clock pulse places shift register U17-1 in state Q0. Only one second later, when the Q1 output of the shift register goes high, does upward carriage travel begin. (Comparable 1-second delays are not required before shift register U17-2 energizes relay K1 or before shift register U15-1 energizes relay K2 as will be described below, because when these shift registers are first enabled motor M2 is not operating. However, the same shift register configurations are utilized for the sake of consistency.)

Shift registers U15-1, U17-1 and U17-2 each have a Q1 output for controlling the energization of a drive relay, and a Q2 output for enabling gate U28-4 so that the height counter can be incremented or decremented. The first clock pulse on conductor 40 which appears after a high potential is applied to the D input of one of the shift registers has no effect in that it simply causes the respective Q0 output to go high. The next clock pulse causes the Q1 output to go high to energize one of the relays, and it is only the following clock pulse which causes the Q2 output to go high, resulting in the transmission of that clock pulse to the height counter. Thus it is apparent that the clock pulses for the height counter are delayed by one clock cycle relative to the start of the incremental steps actually taken by the carriage. This is done purposely so that the height counter will increment or decrement only after an incremental step of the carriage. As soon as the height counter count matches either the skid height or the height dial setting, the particular state in progress ceases, and a respective shift register is reset to de-energize a drive coil relay. Were the height counter to be incremented or decremented at the start of each incremental carriage step, a match would be detected before the carriage actually moved to the height represented by the heighr counter. It is for this reason that the height counter is pulsed only after the carriage has actually moved to the new height.

Upward motion of the carriage in state 2 continues until the bottom of the film roll has reached the level represented by the skid height dial on the control panel. The skid height setting is represented by the three output Q0-Q2 of chip U2 (FIG. 4). This chip is an 8-bit priority encoder. The three bit outputs represent the binary value of the highest input (D0-D7) to which a positive potential is applied. If switch SW5 is set to represent a skid height of 0, the only chip input to which a positive potential is applied is bit D0 which is tied to a positive potential. Consequently, the three output bits represent the binay number 000. If the skid height setting is four inches, a positive potential is applied through switch SW5 to the D2 input of chip U2. This input has priority over input D0, and consequently the three output bits represent a decimal 2, or a binary value of 010. In a similar manner, 6-inch and 8-inch skid height settings result in decimal representations of 3 and 4 at the outputs of chip U2, equal to binary representations of 011 and 100. It will be apparent that the numerical value represented by the outputs of chip U2 is one-half of the skid height setting—0, 2, 3 or 4 corresponding to settings of 0, 4, 6 and 8. The reason for this is that the count represented by the height counter is actually one-half of the actual carriage height because the counter is incremented for every two inches of carriage travel. Thus, for example, when the carriage has moved up six inches, the height counter represents a value of three. To determine when the carriage has moved up to the skid height, a match is looked for between the height in the height counter and the value represented by chip U2. It is for this reason that the output of chip U2 is controlled to be one-half of the actual skid height setting.

The actual comparison is performed by chip U7, a 4-bit magnitude comparator. The three least significant bits of the height counter are coupled to the A0–A2 inputs of the comparator, and the three outputs of chip U2 are connected to the B0–B2 inputs of the comparator. The B3 input is grounded, and similarly a low potential is initially applied to the A3 input. The A3 input is connected to the output of OR gate U8-1, and the three inputs to this gate are all initially low. (During upward movement of the carriage during state 2, the height counter increments up to a maximum count of four, output Q4 of chip U20 and outputs Q1 and Q2 of chip U21 staying at their low values as determined by the overall presetting of a zero count during state 1.) The comparator is wired such that the A>B output is low and the A<B output is high whenever the A inputs represent a value which is less than the value represented by the B inputs. Both outputs are low when the A inputs are incremented up to the value of the B inputs. When the A inputs are greater than the B inputs, the A>B output is high, and the A<B output is low. The chip outputs are inverted by inverters U12-1 and U12-2. Consequently, as the upward motion continues during state 2, but as long as the carriage height represented in the height counter is less than the skid height dial setting, conductor E≦0,4,6,8 is high in potential and conductor E≧0,4,6,8 is low in potential. But as soon as a match is detected, conductor E≧0,4,6,8 goes high. This conductor is connected to one input of gate U6-1 on FIG. 5, and the ST2 conductor is connected to the other input of this gate. As soon as a match is detected, the gate operates and transmits a pulse through OR gates U18-1 and U30 to advance counter U16 to state 3.

It should be noted that if the skid height setting is zero, the output of chip U2 is 000. When a count of zero is pre-set in the height counter during state 1, comparator U7 immediately detectfs a match and conductor E≧0,4,6,8 goes high. This has no effect on gate U6-1 on FIG. 5, however, because during state 1 conductor ST2 is low. But the moment that the system switches to state 2 when down switch SW9 opens, conductor ST2 goes high and the system immediately switches to state 3. This is desired because the skid is to be wrapped along with the load, and no upward carriage travel should be controlled during state 2.

Chip U7 also includes an A=B output (not shown) which could be used to indicate a match. However, it is preferred to use the different A<B and A>B outputs to indicate matches when the carriage is travelling upwardly, and when it is travelling downwardly as will be explained below. The A=B output goes high only momentarily when there is a match. If this output is monitored and for some reason the short-lived pulse is not detected, the system will fail. But by monitoring the two other outputs, this problem will not arise. During upward travel, the E≦0,4,6,8 conductor goes high when the height count matches the skid height and it remains high even as the height count increases. Conversely, during downward travel, the E≦0,4,6,8 conductor goes high when the height count drops to the skid height and it remains high even as the height count decreases (should the carriage not stop, as it should, at the end of state 6).

The function of gate U8-1 on FIG. 4 should also be understood. For the logic to work properly, the E≧0,4,6,8 and E≦0,4,6,8 conductors should change state only when the carriage is near the bottom of its travel. But bit outputs Q1, Q2 and Q3 of chip U20 are the low order bits of the counter, and they cycle from 000 to 111, and then start over again. Thus while the A inputs to comparator U7 increment to the value of the B inputs when the carriage has moved up to the skid height, as the carriage continues to move upwardly the A inputs may actually cycle to represent a value less than the B inputs. It is therefore necessary to force the comparator to always "detect" an A value which is greater than the B value after it first detects this condition, and until the carriage eventually moves down to the skid height range. By coupling the Q4 output of chip U20 and the Q1 output of chip U21 to inputs of OR gate U8-1, the A3 input of comparator U7 will always be high after the height counter first represents a count of 4 (corresponding to a maximum skid height of eight inches). It is only as the height counter is decremented that both of these two inputs to OR gate U8-1 go low as the height counter decrements from a count of 8 to a count of 7. In effect, OR gate U8-1 insures that the comparator detects an A>B condition whenever the opposite, incorrect, condition could otherwise be detected. (The connection of the Q2 output of chip U21 to OR gate U8-1 is not really necessary, but it can do no harm.)

The E≧0,4,6,8 signal is also extended through OR gate U10-3 (FIG. 6) to the reset input of shift register U17-1. The reason for this is that as soon as the system switches to state 3, motor M2 must turn off so tha the bottom wraps may be formed. The pulse extended through the OR gate to the reset input of the register causes the Q1 and Q2 outputs to go low. Not only is relay K1 de-energized, but gate U28-4 is prevented from extending clock pulses to the height counter.

With the system in state 3, the high potential on conductor ST3 on FIG. 5 is extended through OR gates U19-1 and U18-2 to BRAKE CONTROL conductor 26. The other inputs to OR gate U18-2 are conductors ST4, ST5 (through OR gate U19-1), ST6 and ST7. The high potential on conductor 26 controls the build up and then maintenance of the film tension, and this is required during all states starting with state 3. The development of the film tension will be described below. During all of states 3–7, it is also necessary that the turntable revolve. The high potential on conductor 26 is coupled to the base of transistor T1. This transistor conducts and current flows through the coil of table drive relay K3. Whenever this relay is operated, turntable motor M1 is energized to turn the turntable.

Chip U1 on FIG. 5 is an 8-bit shift register with a pre-set capability. When the P/S input is high, one or more of the eight shift register stages is energized depending upon which of inputs P1-P8 are energized. If the "No. of wraps" dial SW6 on the control panel is set to 6, the only input which is energized is input P1 which is tied to a positive potential. During state 2 the high potential on conductor ST2 is extended through OR gate U10-2 to the P/S input. Consequently, stage 1 of the shift register is energized. As will be described, the CLK input is pulsed following each revolution of the turntable, and it causes all of the shift register bits to shift to adjacent more significant positions. The shift register is also provided with eight outputs Q1–Q8, only two of which are utilized. The Q7 output goes high only when a 1 bit is shifted into stage 7 of the register. If switch SW6 is set to represent six wraps, only stage 1 of the shift register is initially set with a 1 bit. It therefore takes six clock pulses for this bit to be shifted to stage 7, at which time output Q7 goes high. On the other hand, suppose that three wraps are desired. In this case, it is stage P4 which is pre-set, along with stage 1. The pre-setting of stage 1 has no effect, because after three clock pulses have been applied to the chip, the 1 bit originally in stage 4 reaches stage 7, and the Q7 output goes high. In a similar manner, it will be apparent that for any other dial setting the Q7 output goes high after the CLK input has been pulsed a number of times equal to the value represented on the dial.

Each time that the turntable finishes a revolution, table switch SW8 is closed. Inverters U13-1 and U13-2, together with the other elements in the switch circuit, form a filter and a Schmitt trigger to provide a sharp clock pulse for shift register U1. After the desired number of clock pulses have been received, the Q7 output of the chip goes high. This output is coupled to one input of gate U3, the other input to which is connected to conductor ST3. Consequently, after the bottomm number of wraps have been formed, a pulse is transmitted from gate U6-3 through OR gate U5-1 to one input of gate U28-2. The other input to this gate is connected to the output of gate U19-1, which output is also high in state 3. Thus a pulse is transmitted through gate U28-2, and OR gates U18-1 and U30, to advance the count of state counter U16 to state 4.

In state 4, the turntable continues to turn, but now the carriage moves upwardly. During state 2, it is shift register U17-1 (FIG. 6) which controls the energization of up drive relay K1. During state 4, it is shift register U17-2 which controls energization of the same relay. Conductor ST4 is connected to one input of gate U11-3. The other input is connected to a positive potential through the normally-closed reinforce switch SW2. The gate thus operates and a positive potential appears on the D input of shift register U17-2. The first clock pulse on conductor 40 causes the Q0 output of the shift register to go high, which has no effect on the system operation. The next clock pulse causes the Q1 output to go high, for enabling transistor T2 through OR gate U19-2 and for operating relay K1. The third clock pulse on conductor 40 causes the Q2 output of the shift register to go high, thus enabling gate U28-4 through OR gate U8-2. All clock pulses on conductor 40, starting with the third, are transmitted through gate U28-4 to increment the height counter. Thus the turntable continues to turn and the carriage is driven upwardly, with the carriage height being represented in the height counter.

Chips U3 and U4 (FIG. 4) are 8-bit priority encoders, and function as does chip U2. But chips U3 and U4 are cascaded (see FIG. 4 on page 5-356 of the Motorola publication referred to above). The setting of height switch SW4 applies a positive potential to one of the fourteen inputs of the cascaded priority encoders. Each priority encoder operates as follows. If at least one of its inputs is high, the binary value of the highest input appears on the output pins Q0–Q2, and the GS output is also high. If none of the inputs is energized, the three outputs Q0–Q2 are low, as is the GS output. Thus if switch SW4 is connected to one of the D0–D7 inputs of chip U4 (corresponding to height settings of 20" to 48" in four-inch increments), outputs Q0–Q2 of chip U4 represent a binary value in the range 000 to 111. With no input of chip U3 energized, all four of its outputs are low. The GS output of chip U3 is connected to the B3 input of comparator U14. Thus for a height setting between 20" and 48", the B3 input of chip U14 is a 0 and the bit values of the Q0–Q2 outputs of chip U4 are extended through OR gates U9-1 through U9-3 to the B0–B2 inputs of comparator U14. On the other hand, if the height setting is anywhere from 52" to 72", the bit outputs of chip U4 (which are all 0) have no effect on the three OR gates. It is now the Q0–Q2 and GS outputs of chip U3 which control the bit values applied to the B0–B3 inputs of the comparator, with the B3 input being a 1.

The net result is that the binary value applied to the B0–B3 inputs of comparator U14 range from 0000 (decimal zero) to 1101 (decimal 13), corresponding to the 14 possible height settings 20"–72".

Comparator U14 operates in a similar manner to comparator U7, but with an important difference. Comparator U7 operates on the three least significant bits of the height counter. Comparator U14 operates on the four most significant bits, outputs Q2, Q3 and Q4 of chip U20 and output Q1 of chip U21 being coupled to the A0–A3 inputs of the comparator. Because comparator U14 "looks at" the height count starting with the second least significant bit, the count at the A0–A3 inputs of the comparator is incremented for every two count advances of the height counter. Consequently, the count actually furnished to the A0–A3 inputs of comparator U14 represents the number of 4-inch increments taken by the carriage from the bottom position.

The width of the film roll used is 20 inches. (A preferred film is polyethylene film CPL/2000 of Favorite Plastic Corporation. This film comes in the form of a 20" wide roll with a 9" diameter; the film has a thickness of 0.001" and a stretch greater than 35%.) A height setting of 20 inches means that the top edge of the film, in its uppermost position, should be 20 inches above the turntable. It is thus apparent that a 20-inch height dial setting corresponds to the carriage remaining in its lowermost position. (A 20-inch height setting should be used only with a skid height setting of zero, since the former means that the carriage will not move up at all, and the skid will thus be wrapped.) On the other hand, consider a maximum height setting of 72". This corresponds to B0–B3 inputs to the comparator of 1101 (decimal 13). A match will be detected when the A0–A3 inputs represent the same value, indicating that the carriage has actually moved up four times as many inches, i.e., 52 inches. This, of course, means that the upper edge of the 20-inch film roll will be at a height 72 inches above the turntable. For all other intermediate height settings, the comparator will determine when the carriage has been moved up an amount sufficient to place the upper edge of the film at the desired height setting. The operator must remember that the height setting is the height above the turntable, and that the desired dial-set height is the sum of the skid height and the actual height of the film on the load relative to the load bottom.

Inverter U29-1 inverts the A<B output of the comparator. As long as the height setting is greater than the actual height of the film roll as represented by the height counter, the E≧MAX conductor remains low. But as soon as the carriage moves to the desired height, the E≧MAX conductor goes high.

The high potential which now appears on the E≧MAX conductor is coupled through OR gate U10-4 on FIG. 6 to the reset input of shift register U17-2. The Q1 and Q2 outputs of the shift register go low, thereby de-energizing the up drive relay K1 and also preventing gate U28-4 from passing clock pulses on conductor 40 to the height counter. The E≧MAX conductor is also connected to one input of gate U11-1 in FIG. 5. The other input of this gate is connected to conductor ST4 which is high during state 4. Gate U11-1 thus operates, and a pulse is transmitted through OR gate U18-1 and U30 to advance counter U16 to state 5.

It is during state 5 that the wraps at the top of the load are formed. During state 4, the high potential on conductor ST4 is extended through OR gate U10-2 (FIG. 5) to the P/S input of chip U1. Thus during state 4, shift register U1 is pre-loaded to reflect the "No. of wraps" dial setting, just as it is during state 2. As soon as state 4 terminates and the ST4 conductor goes low, clock pulses derived from table switch SW8 and appearing at the CLK input of chip U1 cause the contents of the shift register to shift. For the reasons described above, during state 5 the number of turntable revolutions which are counted (or, more accurately, the number of switch SW8 operations) is equal to one greater than the setting of dial SW6. For this reason, it is the Q8 output of the shift register which is now examined for a 1 bit. Gate U6-3, connected to the Q7 output, does not operate because it is enabled only during state 3. As soon as the Q8 output goes high, a positive potential is extended through OR gate U5-1 to one input of gate U28-2. The other input to this gate is enabled through OR gate U19-1 by conductor ST5 as well as conductor ST3. Consequently, a pulse is extended through gate U28-2, and OR gates U18-1 and U30, to advance counter U16 to state 6.

As soon as the system enters state 6, the high potential on conductor ST6 causes gate U11-4 (FIG. 6) to operate, the other input to this state being normally high in potential. The D input of shift register U15-1 goes high and the first clock pulse on conductor 40 causes the Q0 output to go high. While this has no effect on the system, the next two clock pulses cause the Q1 and Q2 outputs to go high. With the Q1 output high, OR gate U19-4 operates to energize the down drive relay K2. With the Q2 output high, OR gate U8-2 enables gate U28-4 so that clock pulses appearing on conductor 40 are extended over CLK conductor 42 to the height counter.

It is in state 6 that the carriage moves down while wrapping the load, and thus the clock pulses on conductor 42 must decrement the height counter. With a high potential on conductor ST6, the output of inverter U12-3 (FIG. 4) is now low. With a low potential at the U/D inputs of chips U20 and U21, each clock pulse causes the height count to decrement.

The carriage continues to move down until comparator U7 determines that the carriage is at the skid height. At this time conductor E≦0,4,6,8 goes high in potential to energize one input of gate U11-2 on FIG. 5. The other input to this gate is enabled by the high potential on conductor ST6, and consequently the output of the gate goes high to extend a pulse through OR gates U18-1 and U30 to advance counter U16 to state 7.

At any time during states 4 and 6, while the carriage is moving up or down, one of gates U11-3 or U11-4 maintains a high potential at the D input of shift register U17-2 or shift register U15-1. It is this high potential which continuously causes high potentials to appear at the Q1 and Q2 outputs of the respective shift register. If at any time reinforce button SW2 is depressed, the high potential on one of the inputs of the operating gate U11-3 or U11-4 is removed. This causes the Q1 and Q2 outputs of the previously operating shift register to go low, thereby de-energizing the previously operated up or down drive relay K1 or K2, and disabling gate U28-4 from passing clock pulses to the height counter. In this condition, additional reinforcing wraps are formed. Upon release of button SW2, carriage motion and height counting resume.

It is gate U11-2 which triggers an advance from state 6 to state 7. In the event the gate fails to operate for some reason and the system remains in state 6, an alternate mechanism is provided to reach state 7. Gate U10-1, one of whose inputs is connected to conductor ST6, enables one input of gate U28-1. As soon as the carriage reaches its lowermost position, down switch SW9 opens and BOTTOM conductor 44 goes high. Gate U28-1 now operates and transmits a pulse through OR gate U30 to advance counter U16 to state 7.

In state 7, the turntable continues to rotate as described above. Conductor ST7 is connected to one input of gate U6-2, this gate thus being enabled during state 7. As soon as the turntable returns to its starting position and table switch SW8 closes, the output of inverter U13-2 goes high and gate U6-2 operates. The resulting pulse through OR gate U30 advances counter U16 to state 0 in preparation for another cycle. At this time, OR gate U18-2 is no longer operated and the BRAKE CONTROL conductor 26 goes low. The film tension is returned to its minimum value and the film is cut by the operator.

FIG. 7 depicts the motor connections. Turntable motor M1 is simply connected through a fuse F3 and normally-open contacts K3-1 of relay K3 to the power lines 10 and 12. Whenever relay K3 is operated, motor M1 is energized. Carriage motor M2 is contained in a vertical motor control circuit 60. Power from lines 10 and 12 is delivered to the control circuit through fuse F4 and either normally-open contacts K1-1 or K2-1, depending on which of the up and down drive relays is energized. Also depending on which relay has operated, either contacts K1-2 and K1-3 are closed, or contacts K2-2 and K2-3 are closed. Depending on which of the two relays is energized, motor M2 runs in a direction which controls up or down operation of the carriage. The details of the motor direction control are not important for an understanding of the present invention, and any suitable reversible motor control can be used.

FIG. 8 depicts the manner in which the brake force (film tension) is derived, and the operation of this circuit will be understood with reference to the waveforms shown in FIG. 9.

As described above, a sawtooth waveform appears on conductor ST30 (see FIG. 9), the sawtooth pulses occurring at a rate of 120 Hz. Initially, the high potential across capacitor C6 is applied to the minus input of comparator U24-2. The sawtooth waveform conductor ST30 is applied to the plus input. Whenever the potential at the minus input is higher than the potential on conductor ST30, the comparator output is low and light-emitting diode 32 is held on. But whenever the sawtooth potential rises above the DC potential at the minus input, the comparator output goes high and the light-emitting diode turns off. Diode 32 is optically coupled to photo-transistor 34. Whenever the diode is on, current flows through the transistor.

During states 0, 1 and 2, BRAKE CONTROL conductor 26 is low in potential and the output of comparator U23-2 is high. Capacitor C6 charges through diode CR11 to a maximum value. The capacitor voltage is shown on FIG. 9 as waveform B, and it is apparent that at the start of a cycle the capacitor voltage is at a maximum. Since this voltage is greater than the peak sawtooth potential, diode 32 remains on. This is represented by waveform C on FIG. 9, and the notation "LED ON". But at the start of state 3, BRAKE CONTROL conductor 26 goes high in potential. The output of comparator 23-3 goes low, and diode CR11 is reverse biased. Capacitor C6 now discharges through brake time control potentiometer R3 to the potential at the center tap of potentiometer R1, this potential being determined by Zener diode Z2 and the potentiometer settings. Waveform B on FIG. 9 shows the voltage across the capacitor as it discharges. During the peak portion of each sawtooth, the plus input of comparator U24-2 is at a higher potential than the minus input, and the comparator output goes high, thus turning off light-emitting diode 22. This is shown by the "LED OFF" indication for waveform C in FIG. 9. The light-emitting diode turns off for a longer and longer fraction of successive cycles.

Diodes CR6, CR7, CR9 and CR10 comprise a bridge rectifier for furnishing current from lines 10 and 12, through fuse F2 to transistors 46 arranged in a Darlington configuration. The transistors are connected across the bridge output. Current flows from either of diodes CR6 or CR9, through brake 38, through transistors 46, and then through one of diodes CR7 or CR10. Whenever transistor 34 conducts, the effective base-emitter junction of transistors 46 is short-circuited and the transistors do not conduct. At this time, diode CR8 allows the current in the brake coil to dissipate. But whenever transistor 34 is turned off, transistors 46 conduct and brake current flows. The voltage across the brake is shown in the bottom waveform of FIG. 9, the brake voltage simply following the rectified line voltage whenever light-emitting diode 32 is off. The configuration is basically a variable phase control driver with the phase angle being modulated by the control voltage on capacitor C6. For high voltages on the capacitor, there is no voltage across the brake (see left side of FIG. 9). As the capacitor voltage is lowered, current flows through the brake for a greater fraction of each cycle. The brake force is approximately proportional to the average area under the brake voltage waveform. It is apparent that the brake current which flows due to the conduction of transistors 46 builds up from a minimum value to a maximum value as capacitor C6 discharges. It should be noted that the capacitor voltage waveform B in FIG. 9 is shown decreasing much faster than it does in actual practice in order that the principles of operation be understood. As described above, it takes approximately one half turn of the turntable before a sufficient time has elapsed for the brake force to reach its maximum value. A further advantage of the brake control is that due to precise regulation a very uniform brake force (film tension) is achieved.

Brake tension control potentiometer R1, on the control panel, controls the final voltage which remains on capacitor C6 after it is discharged. This, in turn, fixes the maximum period of conduction of transistors 46 during each half cycle of the line potential, and thus the operator can set the maximum film tension. Potentiometer R2 is not under control of the operator, and it determines the maximum brake force. Even if the operator moves the center tap of potentiometer R1 to the bottom end of the potentiometer as shown in FIG. 8, capacitor C6 can still not fully discharge. The capacitor can discharge only to the voltage at the center tap of potentiometer R2. In effect, potentiometer R2 limits the maximum conduction angle of transistors 46. Potentiometer R3 determines the time which is required for capacitor C6 to discharge to the minimum potential. This is also a factory set adjustment. As described above, in the usual case, the capacitor voltage drops to the minimum value in the time that it takes for the turntable to make between one-sixteenth and one full revolution.

It will be noted in FIG. 9 that there is no voltage applied across the brake at the beginning of the wrapping cycle (until state 3 is reached) because transistors 46 remain off. Actually, the brake voltage waveform in FIG. 9 is the brake voltage as determined by the conduction of transistors 46. As described above, even in states 0–2, some minimum value of brake force is desired to prevent spinning of the film roll. Brake pre-tension control potentiometer R4 is connected in parallel with transistors 46. Thus even in states 0–2, some current does flow through the brake as determined by the factory-set adjustment of potentiometer R4.

Although the invention has been described with reference to a particular embodiment, it is to be understood that this embodiment is merely illustrative of the application of the principles of the invention. It is possible, for example, to omit the carriage-moving feature of the invention and yet still to utilize the concept of building up the film tension continuously. It is also possible to hold the film roll stationary, even in a horizontal orientation, yet to move the film itself as it pulled off the roll such that it moves up and down to form a spiral wrap. It is also feasible to implement the front panel controls, particularly the height and skid settings, in numerous other formats, e.g., in formats other than heights above the turntable. Thus it is to be understood that numerous modifications may be made in the illustrative embodiment of the invention and other arrangements may be devised without departing from the spirit and scope of the invention.

I claim:

1. A spiral stretch wrap machine comprising means for holding a roll of stretch wrap material in a vertical orientation; a horizontal turntable for supporting a load to be wrapped; means for turning said turntable; means for moving said roll in the vertical direction such that following the securement of the free end of said roll to said load, stretch wrap material is pulled off from said roll and wound in a spiral around said load; and means for automatically applying a continuously increasing brake force to said roll to inhibit the pulling off of stretch wrap material therefrom, said brake force increasing continuously from a minimum value to a maximum value during the initial wrapping of said load and thereafter remaining at said maximum value, said turntable turning through at least one-sixteenth of a turn and at most one complete turn during the time that said brake force is increasing from said minimum value to said maximum value.

2. A spiral stretch wrap machine in accordance with claim 1 wherein vertical motion of said roll is stopped while said turntable is still turned when the bottom and the top of said load are being wrapped to provide additional wrap reinforcement at the bottom and top of said load, said brake force increasing from said minimum value to said maximum value while vertical motion of said roll is not in progress.

3. A spiral stretch wrap machine in accordance with claim 1 wherein said maximum brake force is reached before said turntable has made one half of a revolution at the start of a wrapping operation.

4. A spiral stretch wrap machine in accordance with claim 1 further including manually settable means for indicating whether a support between said turntable and said load is to be wrapped together with the load, and means for controlling the lowest level to which said film roll is moved to selectively wrap said support in accordance with the indication of said manually settable means.

5. A spiral stretch wrap machine in accordance with claim 1 further including manually settable numerical-value representing means for controlling the vertical level at the bottom of the load below which wrapping does not take place.

6. A spiral stretch wrap machine in accordance with claim 1 further including manually settable numerical-value representing means for controlling the vertical level at the top of the load above which wrapping does not take place.

7. A spiral stretch wrap machine in accordance with claim 1 wherein said moving means moves said roll from the bottom of said load to the top, and then back down again.

8. A spiral stretch wrap machine in accordance with claim 1 further including manually settable means for representing and controlling the bottom and top limits for said moving means.

9. A spiral stretch wrap machine in accordance with claim 1 further including manually-controlled means for disabling the operation of said moving means while said turntable continues to rotate, thereby allowing selected portions of said load to be wrapped with additional layers of wrap material.

10. A spiral stretch wrap machine in accordance with claim 1 further including means for manually setting the maximum value of said brake force.

11. A spiral stretch wrap machine in accordance with claim 1 further including means for adjusting said minimum value of brake force.

12. A spiral stretch wrap machine in accordance with claim 1 further including means for adjusting the time interval during which said brake force builds up from said minimum value to said maximum value.

13. A stretch wrap machine comprising means for holding a roll of stretch wrap material in a vertical orientation; a horizontal turntable for supporting a load to be wrapped; means for turning said turntable; and means for automatically applying a continuously increasing brake force to said roll to inhibit the pulling off of stretch wrap material therefrom, said brake force increasing continuously from a minimum value to a maximum value during the initial wrapping of said load and thereafter remaining at said maximum value, said turntable turning through at least one-sixteenth of a turn and at most one complete turn during the time that said brake force is increasing from said minimum value to said maximum value.

14. A stretch wrap machine in accordance with claim 13 wherein said maximum value brake force is reached after said turntable has made one-sixteenth of a revolution and before it has made one half of a revolution.

15. A stretch wrap machine in accordance with claim 13 further including means for manually setting the maximum value of said brake force.

16. A stretch wrap machine in accordance with claim 13 further including means for adjusting said minimum value of brake force.

17. A stretch wrap machine in accordance with claim 13 further including means for adjusting the time interval during which said brake force builds up from said minimum value to said maximum value.

18. A stretch wrap machine in accordance with claim 13 wherein said maximum brake force is reached before said turntable has made one half of a revolution at the start of a wrapping operation.

19. A stretch wrap machine for wrapping a load contained on a skid comprising a turntable for supporting said skid and said load; means for rotating said turntable; a supply of stretch wrap film; means for moving said film in the vertical direction while drawing it from said supply such that after the free end of said film is secured to said load, said film is wrapped around said load in the form of a spiral as said film moves in the vertical direction and said turntable rotates; first manually settable means for representing a numerical value corresponding to the lowest level above said turntable at which wrapping is to take place; second manually settable means for representing a numerical value corresponding to the highest level on said load at which wrapping is to take place; means responsive to said first and second numerical value representing means for limiting movement of said film between said lowest and said highest levels, and means for automatically applying a continuously increasing brake force to said film, said brake force increasing from a minimum value to a maximum value while said turntable turns through at least its first one-sixteenth of a turn and at most its first complete turn.

20. A stretch wrap machine in accordance with claim 19 wherein said moving means moves said film in the vertical direction from one of said lowest or highest levels to the other, and then back again.

21. A stretch wrap machine in accordance with claim 20 further including means for inhibiting the operation of said moving means while said film is at said lowest and said highest levels to provide additional wrap reinforcement at the bottom and top of the load.

22. A stretch wrap machine in accordance with claim 21 further including third manually settable means for numerically representing and controlling the number of additional wraps formed around said load at the bottom and top thereof.

23. A stretch wrap machine in accordance with claim 19 wherein said brake force builds up to said maximum value within the first half of a revolution of said turntable and thereafter is maintained at said maximum value.

24. A stretch wrap machine in accordance with claim 19 further including means for enabling an operator to select the maximum brake force applied to said film.

25. A stretch wrap machine in accordance with claim 1 wherein said maximum film tension is reached before said turntable has made one complete revolution.

* * * * *